US005536009A

United States Patent [19]

Edwards

[11] Patent Number: 5,536,009

[45] Date of Patent: Jul. 16, 1996

[54] POOL PUZZLE, METHOD OF PLAY

[75] Inventor: Scott D. Edwards, Benbrook, Tex.

[73] Assignee: Insulation Materials Corporation of America, Haltom City, Tex.

[21] Appl. No.: 234,058

[22] Filed: Apr. 28, 1994

[51] Int. Cl.[6] ..... A63F 9/10

[52] U.S. Cl. ..... 273/157 R; 273/287; 273/DIG. 4; 446/153

[58] Field of Search ..... 273/287, 157 R, 273/DIG. 4; D21/16; 446/153

[56] References Cited

U.S. PATENT DOCUMENTS

| | | | |
|---|---|---|---|
| D. 259,497 | 6/1981 | Mahler | D21/16 |
| 2,952,462 | 9/1960 | Planin | 446/153 |
| 3,107,095 | 10/1963 | Cairns | 446/153 |
| 3,251,600 | 5/1966 | Warnberg | 273/287 |
| 3,280,499 | 10/1966 | Studen | 446/118 |
| 3,619,833 | 11/1971 | Keller | 446/153 |
| 3,701,214 | 10/1972 | Sakamoto | 446/115 |
| 4,202,134 | 5/1980 | Morrison | 273/157 R |

OTHER PUBLICATIONS

Washington Herald, "It Isn't The Game That Counts, But Where You Play It", Friday, Jul. 9, 1937.

*Primary Examiner*—Benjamin H. Layno

*Attorney, Agent, or Firm*—James E. Bradley; Mark W. Handley

[57] ABSTRACT

A method for playing an outdoor recreational game provided in which puzzle pieces are formed from a flat sheet of foam plastic material having end edges which extend in alternating protrusions and recesses for joining together to interlock the puzzle pieces according to a predetermined arrangement. The puzzle pieces are laminated with a first graphic design disposed on a front side of the puzzle pieces for providing a guide for assembling the puzzle pieces according to the predetermined arrangement. An alternate graphic design is provided on a back side of the puzzle pieces for providing an alternate means to the first graphic design for guiding assembly of the puzzle pieces. The puzzle pieces are adapted for outdoor assembly to provide use as an outdoor recreational game. Further, the interlocking puzzle pieces are together sized to require that a player assembling the puzzle pieces move from a first position to a second position, which is distal to the first position, for fully assembling the puzzle pieces when the jigsaw puzzle is assembled at a stationary reference position.

6 Claims, 1 Drawing Sheet

POOL PUZZLE, METHOD OF PLAY

BACKGROUND OF THE INVENTION

1. Field of the Invention

This invention relates in general to recreational games, and in particular to a jigsaw puzzle for use as an outdoor recreational game.

2. Description of the Prior Art

Prior art jigsaw puzzles have been used for recreational games to be played indoors on a table top. Typically, prior art jigsaw puzzles are made from laminated cardboard. These types of prior art jigsaw puzzles are not suitable for use as an outdoor recreational game, such as a yard game or a swimming pool game. If exposed to variable outdoor conditions, jigsaw puzzles formed from laminated cardboard will deteriorate rapidly.

Further, prior art jigsaw puzzles are typically assembled on a table top, with the player able to fully assemble the puzzle from a seated position. Thus, a player is not required to perform much physical exertion to assemble the puzzle pieces. For an outdoor recreational game, such as a yard game or swimming pool game, it is desirable to require that a player move between distal positions to require physical assertion.

SUMMARY OF THE INVENTION

A jigsaw puzzle and a method for playing an outdoor recreational game are provided in which puzzle pieces are formed from a flat sheet of foam plastic material having end edges which extend in alternating protrusions and recesses for joining together to interlock the puzzle pieces according to a predetermined arrangement. The puzzle pieces are laminated with a first graphic design disposed on a front side of the puzzle pieces for providing a guide for assembling the puzzle pieces according to the predetermined arrangement. An alternate graphic design is provided on a back side of the puzzle pieces for providing an alternate means to the first graphic design for guiding assembly of the puzzle pieces. The puzzle pieces are adapted for outdoor assembly to provide use as an outdoor recreational game, particularly in a swimming pool. Further, the interlocking puzzle pieces are together sized to require that a player assembling the puzzle pieces move from a first position to a second position, which is distal to the first position, for fully assembling the puzzle pieces when the jigsaw puzzle is assembled at a stationary reference position.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
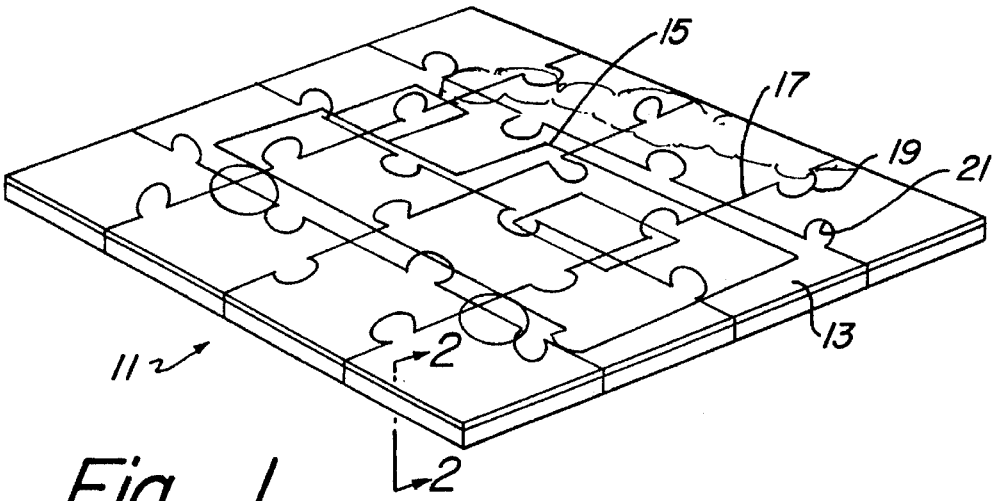
FIG. 1 is a perspective view of a pool puzzle of the present invention.

FIG. 1 is a perspective view of pool puzzle 11 of the present invention. Pool puzzle 11 is a jigsaw puzzle for providing an outdoor recreational game. Pool puzzle 11 includes puzzle pieces 13 on which graphic design 15 appears.

Puzzle pieces 13 include end edges 17 which extend in protrusions 19 and recesses 21. Protrusions 19 are provided for mating with recesses 21 to interlock puzzle pieces 13 together according to a predetermined arrangement in which graphic design 15 appears as shown. As is typical with jigsaw puzzles, graphic design 15 provides a means for guiding assembly of puzzle pieces 13 to fully assemble pool puzzle 11.

Figure 2:
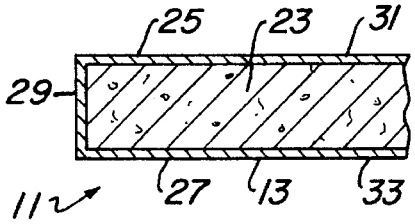
FIG. 2 is a partial sectional view taken along section 2—2 of FIG. 1 for depicting one of puzzle pieces of a pool puzzle of the present invention.

FIG. 2 is a partial sectional view taken along section line 2—2 of FIG. 1 depicting one of puzzle pieces 13 of pool puzzle 11. Pool puzzle 11 includes a core formed of a sheet of foam plastic material, which in the preferred embodiment of the present invention is closed cell polyethylene foam plastic which will float. Exterior laminate layer 25 is laminated on top of core 23. Exterior laminator layer 27 is laminated on an opposite side of core 23 from exterior laminate layer 25. End surface laminate layer 29 extends on the end of core 23, in this preferred embodiment of the present invention.

It should be noted that end surface laminate layer 29 may extend either between pieces 13 of puzzle 11, or just about the exterior edge of pool puzzle 11. Further, in some embodiments of the present invention, merely a core may be used with a graphic design disposed thereon by directly forming the graphic design into the core, or depositing the graphic design directly thereon, rather than having an exterior laminate layer for laminating a graphic design onto the core. In the preferred embodiment of the present invention, graphic design 15 (shown in FIG. 1) is disposed on exterior laminate layer 25, which may be considered to provide a front side 31 of pool puzzle 11. Exterior laminate layer 27 may then be considered to provide back side 33 of pool puzzle 11.

Figure 3:
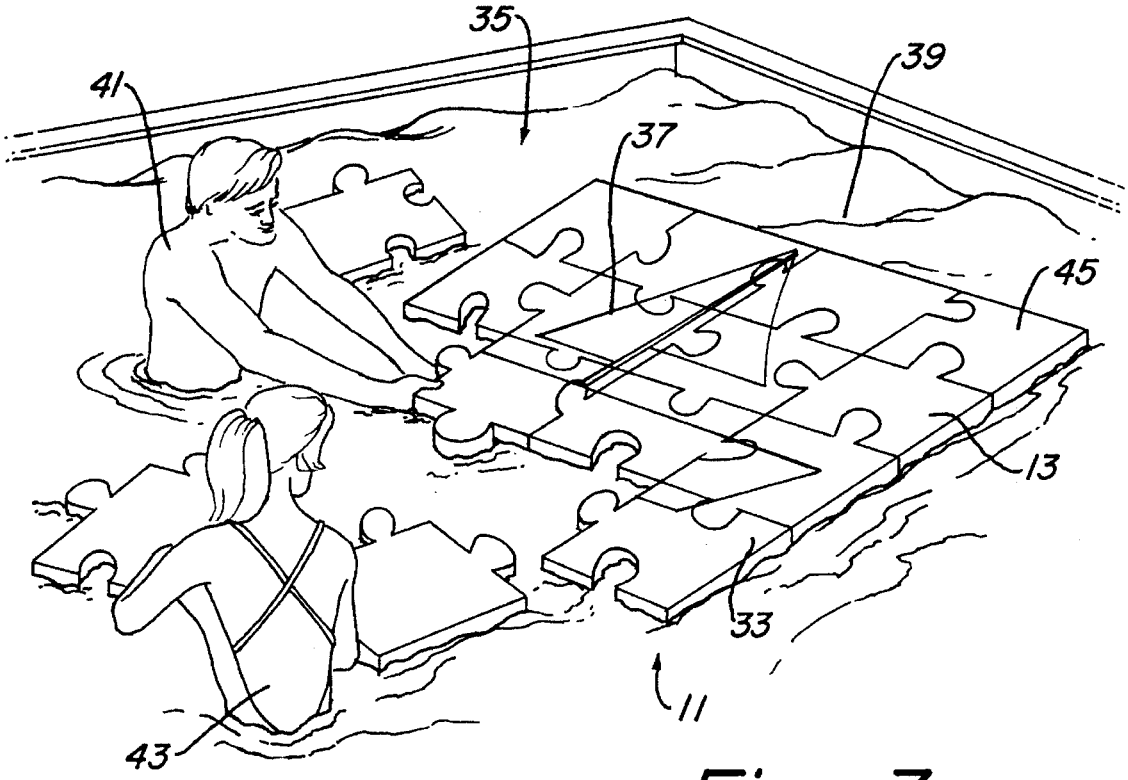
FIG. 3 is a perspective view depicting assembly of a pool puzzle of the present invention within a swimming pool.

Referring to FIG. 3, a perspective view depicts pool puzzle 11 within swimming pool 35. Back side 33 of pool puzzle 11 is depicted as being face up, with alternate graphic design 37 depicted thereon. It should be noted that in the preferred embodiment of the present invention, pool puzzle 11 will float on top surface 39 of water within swimming pool 35. Being closed cell, pieces 23 do not absorb water. A first person 41 is depicted as assembling pool puzzle 11 with the aid of a second person 43.

Pool puzzle 11 may be played as either a swimming pool game, or as a yard game by playing on a lawn rather than in a swimming pool 35. For example, to play an outdoor recreational game with pool puzzle 11, the pieces may be scattered about either within swimming pool 39 or within a lawn of a yard, and then assembled as shown in FIG. 3 by interlocking pieces 13 together so that alternative graphic design 37 is fully depicted. Pool puzzle 11 may also be used to play a competitive type of game, such as if competitors 41 and 43 were to race to determine who could assemble the most pieces over a preselected period of time.

It should be noted that pool puzzle 11 and the puzzle pieces 13 are sized thus so that a person assembling pool puzzle 11 will be required to move from one point to another point which is distal from the first point. For example, person 41 could not reach across to opposite side 45 of puzzle 11 to interlock a puzzle piece 13 on opposite side 45 without moving to opposite side 45 if pool puzzle 11 remains in a stationary reference position such as that depicted in FIG. 3. Pool puzzle 11 is preferably sized to have a length and width which range from four (4) feet to ten (10) feet, although other embodiments of the present invention may have lengths and widths which are not in this range.

The present invention offers several advantages over prior art jigsaw puzzles. The jigsaw puzzle of the present invention may be played as an outdoor recreational game, such as for use in a swimming pool or on a lawn. Further, a person assembling the present invention is required to move from one point to another to fully assemble the jigsaw puzzle of the present invention if the puzzle is assembled at a stationary referenced position.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. A method for playing a recreational game in a swimming pool, the method comprising the steps of:

providing a jigsaw puzzle having a plurality of buoyant puzzle pieces formed from a foam plastic material, the plurality of buoyant puzzle pieces having edges which extend in alternating protrusions and recesses for joining together to interlock according a predetermined arrangement defined according to a first graphic design disposed thereon;

scattering the plurality of buoyant puzzle pieces into a disassembled arrangement within a swimming pool;

aligning the plurality of buoyant puzzle pieces for matching the protrusions and the recesses to interlock the plurality of buoyant puzzle pieces into the predetermined arrangement defined according to the first graphic design disposed thereon;

interlocking the plurality of buoyant puzzle pieces to insert the protrusions into the recesses to assemble the plurality of buoyant puzzle pieces in the predetermined arrangement defined according to the first graphic design disposed thereon; and wherein aligning the plurality of buoyant puzzle pieces requires a player to move from a first position to a second position, which is distal from the first position, to fully align the plurality of buoyant puzzle pieces for matching the protrusions and the recesses to interlock the plurality of buoyant puzzle pieces into the predetermined arrangement defined according to the first graphic design disposed thereon when the plurality of buoyant puzzle pieces are assembled at a stationary reference position.

2. The method of claim 1, wherein an alternate graphic design is disposed on a backside of the plurality of buoyant puzzle pieces, opposite from a front side of the plurality of buoyant puzzle pieces on which the first graphic design is disposed, and the method further comprises the steps of:

scattering the plurality of buoyant puzzle pieces again into another disassembled arrangement a within the swimming pool;

realigning the plurality of buoyant puzzle pieces according to the alternate graphic design printed on the backside of the plurality of buoyant puzzle pieces; and interlocking the plurality of buoyant puzzle pieces to insert the protrusions into the recesses to assemble the jigsaw puzzle according to the alternate graphic design disposed on the backside of the plurality of buoyant puzzle pieces.

3. The method of claim 1, further comprising the step of:

two persons competing in performing the steps of aligning the plurality of buoyant puzzle pieces and interlocking the plurality of buoyant puzzle pieces to determine who can assemble the largest number of the plurality of buoyant puzzle pieces over a period of time.

4. The method of claim 1, wherein the plurality of buoyant puzzle pieces are formed from a foam plastic material, and the method further comprises the step of:

providing a flat sheet of closed cell polyethylene material; further comprising; and two persons competing in performing the steps of aligning the plurality of buoyant puzzle pieces and interlocking the plurality of buoyant puzzle pieces to determine who can assemble the largest number of the plurality of buoyant puzzle pieces over a period of time.

5. The method of claim 1, wherein the step of providing a jigsaw puzzle having a plurality of buoyant puzzle pieces formed from a foam plastic material comprises the steps of:

providing a flat sheet of closed cell polyethylene material;

laminating the graphic design upon a front side of the closed cell polyethylene material; and cutting the plurality of buoyant puzzle pieces from the flat sheet of closed cell polyethylene material by separating the plurality of buoyant puzzle pieces to define the edges which extend in alternating protrusions and recesses.

6. The method of claim 1, wherein the step of providing a jigsaw puzzle having a plurality of buoyant puzzle pieces formed from a foam plastic material comprises the steps of:

providing a flat sheet of closed cell polyethylene material;

disposing the graphic design upon a front side of the closed cell polyethylene material;

disposing an alternate graphic design upon a backside of the closed cell polyethylene material; and cutting the plurality of buoyant puzzle pieces from the flat sheet of closed cell polyethylene material by separating the plurality of buoyant puzzle pieces to define the edges which extend in alternating protrusions and recesses.

* * * * *